United States Patent [19]

Bernard

[11] Patent Number: 5,019,158

[45] Date of Patent: May 28, 1991

[54] PROCESS FOR THE SEPARATION OF CALCIUM AND NITROGEN FROM LITHIUM

[75] Inventor: Guy Bernard, Moutiers, France

[73] Assignee: Metaux Speciaux S.A., Courbevoie, France

[21] Appl. No.: 524,451

[22] Filed: May 16, 1990

[30] Foreign Application Priority Data

Jun. 9, 1989 [FR] France ..... 89 08144

[51] Int. Cl.[5] ..... C22B 26/12

[52] U.S. Cl. ..... 75/408; 75/589; 75/710

[58] Field of Search ..... 75/408, 589, 745

[56] References Cited

U.S. PATENT DOCUMENTS 3,287,109 11/1966 Moolenaar ..... 75/408

4,781,756 11/1988 Frianeza-Kullberg et al. ..... 75/745

*Primary Examiner*—Melvyn J. Andrews

*Attorney, Agent, or Firm*—Dennison, Meserole, Pollack & Scheiner

[57] ABSTRACT

A process is disclosed for separating calcium and nitrogen from lithium, in which alumina is added to molten lithium and reacts to produce aluminum and lithium oxide. The aluminum reacts with the nitrogen in the lithium to produce insoluble aluminum nitride, while the lithium oxide reacts with the calcium present to produce insoluble calcium oxide and lithium. The insoluble calcium oxide and aluminum nitride may then be separated from the molten lithium, such as by filtration.

7 Claims, No Drawings

PROCESS FOR THE SEPARATION OF CALCIUM AND NITROGEN FROM LITHIUM

The present invention relates to a process for the separation of calcium and nitrogen from lithium.

Metallic lithium is generally obtained by fusion electrolysis of lithium chloride, which can contain impurities such as calcium chloride. This salt is in particular dissociated by electric current and is consequently in the form of calcium in the metal obtained, where it can have a content of several hundred ppm. This element is particularly prejudicial when the metal is used for producing aluminium-lithium alloys, because it tends to bring about a deterioration to their mechanical characteristics.

Moreover, during its preparation lithium sometimes comes into contact with air. As it is particularly sensitive to the action of nitrogen, it tends to form nitrides, whose content can be up to several hundred ppm. However, these nitrides are very hard compounds, whose presence in the alloys will lead to problems not only with respect to their properties, but also during their shaping, as a result of their abrasive action on the equipment used, i.e. the rolling mill roll, ingot mould, extrusion die, etc. In particular, these nitrides embrittle the lithium sheets used as electrodes in electric batteries.

As a result it is necessary to remove the calcium and nitrogen contained in the lithium or at least reduce the content of these impurities to a value generally below 100 ppm prior to the use thereof in the state of a metal or alloy.

It is not possible to separate the calcium by filtration, because it has a relatively high solubility in lithium. Moreover, although distillation is a convenient process for purifying lithium with respect to sodium and potassium, it is not very effective with respect to alkaline earth elements and in particular calcium. Although it is known that certain compounds of calcium such as CaO are insoluble in lithium, a priori it could be though that calcium oxidation in situ would also lead to an oxidation of the lithium. Thus, it was found that oxygen introduced into lithium tended to be fixed in preferred manner to the calcium. Furthermore, by adding an oxygen quantity calculated for fixing all the calcium present and by then filtering the lithium, it is possible to carry out a calcium purification to contents compatible with the specifications of aluminium-lithium manufacturers.

There are several ways for introducing oxygen into lithium. Thus, gaseous oxygen can be bubbled into liquid lithium, but this method is not very suitable because the reaction can be locally violent and may rapidly lead to the clogging of the oxygen supply piping by lithium oxide. It is also possible to add lithium oxide to melted lithium, so as to produce the following reaction:

$$Li_2O + Ca \rightarrow CaO + 2\ Li$$

This method is very interesting, because it brings about purification without causing other pollution. However, lithium oxide is not a commercially available product and it is consequently necessary to product it first, which increases the purification costs.

In addition, these oxidation methods would not appear to provide a solution to the separation of the nitrogen from the lithium in nitride form. Thus, among the known methods, reference is e.g. made to that described in U.S. Pat. No. 4,781,756 consisting of adding a stoichiometric aluminium quantity so as to obtain the reaction $Li_3N + Al \rightarrow AlN + 3Li$, followed by the separation of the aluminium nitride formed. However, it is not the aluminium which would make it possible to oxidize the calcium.

However, research has been carried out by the Applicant for finding a solution simultaneously suitable for the elimination of both impurity types and as far as possible using only a single reagent.

This research has led to a process characterized in that to the lithium is added alumina divided so as to form aluminium nitride and calcium oxide in insoluble form and hot separation takes place of said insoluble substance in order to recover the purified liquid lithium.

Under these conditions, part of the lithium reduces the aluminium oxide and is transformed into lithium oxide, which can be used for oxidizing the calcium according to the reaction described hereinbefore. Moreover, the aluminium which has formed during the reduction of the alumina by lithium reacts with the lithium nitride in order to give aluminium nitride, as in U.S. Pat. No. 4,781,756.

The insoluble calcium oxide and aluminium nitride can then be separated at the same time from the liquid lithium. Thus, with a single reagent, i.e. alumina, the two impurities are simultaneously eliminated from the lithium. The small aluminium quantity which can be left behind in the lithium is not disadvantageous, particularly if used in the production of aluminium-lithium alloys. Moreover, alumina is a widely available product which can be obtained in a very pure state and is sufficiently divided form to rapidly react with the lithium.

The alumina quantities to be used will depend on the calcium and nitrogen quantities present in the lithium, but it must be borne in mind that they are cumulative, the same alumina fraction being used simultaneously for the elimination of both impurities according to the following successive reactions:

$$Al_2O_3 + 6\ Li \rightarrow 3Li_2O + 2\ Al$$

$$3Li_2O + 3\ Ca \rightarrow 3\ CaO + 6\ Li$$

$$2Li_3N + 2\ Al \rightarrow 2\ AlN + 6\ Li$$

It should be noted that the alumina quantity sufficient for eliminating 3 gramme atoms of calcium also makes it possible to eliminate 2 gramme atoms of nitrogen.

Thus, the appropriate alumina quantity is calculated from the impurity which, as a result of its content, requires the greatest quantity thereof, but in practice use is made of quantities approximately 10% by weight higher than the calculated quantity. The alumina used preferably has a grain size below 3 mm, so as to react as quickly as possible with the lithium.

However, in order to facilitate the reactions, it is preferably to keep the melted lithium bath at between 400° and 500° C. for at least one hour prior to carrying out the separation of the insoluble substances which have formed. An improvement to the process consists of stirring the lithium-alumina mixture during its temperature maintenance.

The separation of the aluminium nitride and the calcium oxide can take place by any known means and preferably by filtration. This operation takes place hot, but in order to ensure a better behaviour of the equipment, it is preferably to operate at a temperature below the maintenance temperature, i.e. at between 200° and 250° C.

The invention is illustrated by the following examples.

EXAMPLE 1

To 100 kg of lithium containing 250 ppm of calcium and 120 ppm of nitrogen are added 50 g of alumina with a grain size of 0.5 mm and the mixture is heated to 480° C. for 8 hours. After cooling and filtering at 220° C., the lithium only contained 40 ppm of calcium and 60 ppm of nitrogen and its aluminium content was 130 ppm.

EXAMPLE 2

To 100 kg of lithium containing 200 ppm of calcium and 1500 ppm of nitrogen were added 50 g of alumina with a grain size of 1 mm and the mixture was heated to 480° C. for 8 hours. Following filtration on a Poral class 20 filter candle at 220° C., the lithium only contained 20 ppm of calcium and 250 ppm of nitrogen and its aluminium content was 50 ppm.

The invention is applicable to obtaining lithium in a quality particularly suitable for producing aluminium-lithium alloys and electrodes for electric batteries.

I claim:

1. A process for separating calcium and nitrogen from molten lithium, comprising the steps of:

introducing divided alumina into the molten lithium;

allowing the alumina to react with the molten lithium to produce aluminum and lithium oxide;

allowing the aluminum to react with the nitrogen to produce insoluble aluminum nitride;

allowing the lithium oxide to react with the calcium to produce insoluble calcium oxide and lithium;

separating the insoluble calcium oxide and aluminum nitride from the molten lithium.

2. A process according to claim 1, wherein said nitrogen is present in said molten lithium in the form of lithium nitride and said aluminum reacts with said lithium nitride to produce insoluble aluminum nitride and lithium.

3. Process according to claim 1, wherein the alumina is added in the form of powder with a grain size below 3 mm.

4. Process according to claim 1, wherein the lithium and the alumina are maintained at between 400° and 500° C. for at least one hour prior to carrying out separation.

5. Process according to claim 1, wherein the lithium and the alumina are stirred throughout the temperature maintenance period.

6. Process according to claim 1, wherein said separating takes place by filtration.

7. Process according to claim 1, wherein separation takes place at a temperature between 200° and 250° C.

* * * * *